United States Patent [19]

Ansen et al.

[11] 4,280,283

[45] Jul. 28, 1981

[54] METHOD AND DEVICE FOR THE OPERATION OF A HOT GAS GENERATOR WITHIN A DRYER

[75] Inventors: Jakob Ansen; Helmut Duill, both of Cologne; Heinz Fasbender, Krefeld, all of Fed. Rep. of Germany

[73] Assignee: Klöckner-Humboldt-Deutz AG, Fed. Rep. of Germany

[21] Appl. No.: 99,479

[22] Filed: Dec. 3, 1979

[30] Foreign Application Priority Data

Dec. 2, 1978 [DE] Fed. Rep. of Germany ..... 2852164

[51] Int. Cl.[3] ..... F26B 3/10

[52] U.S. Cl. ..... 34/10; 34/35; 34/57 R; 34/86; 34/102; 432/72

[58] Field of Search ..... 34/35, 86, 57 R, 57 A, 34/10, 102; 432/59, 8, 72

[56] References Cited

U.S. PATENT DOCUMENTS

| | | | |
|---|---|---|---|
| 2,213,668 | 9/1940 | Dundas et al. | 34/35 |
| 3,122,425 | 2/1964 | Wasp | 34/86 |
| 3,787,171 | 1/1974 | Cromp | 432/59 |
| 3,884,620 | 5/1975 | Rammler | 34/57 R |
| 4,132,007 | 1/1979 | Voorheis | 34/86 |

FOREIGN PATENT DOCUMENTS

| | | |
|---|---|---|
| 475815 | 5/1929 | Fed. Rep. of Germany . |
| 1283655 | 11/1968 | Fed. Rep. of Germany . |

*Primary Examiner*—Larry I. Schwartz

*Attorney, Agent, or Firm*—Hill, Van Santen, Steadman, Chiara & Simpson

[57] ABSTRACT

A dryer system, such as is used in a pulverizing mill assembly, includes a hot gas generator which supplies drying gas to the starting point for a gas circulation system. The drying gas passes through the circulation system commingling with particles to be dried. The dried particles are removed whereupon the system gas flow is divided into a return portion and a spent portion for expulsion to ambient. Part of the system return flow is further freed of particles, compressed, and supplied to the hot gas generator as secondary gas. The return gas flow into the generator is regulated to control hot gas temperature in response to generator flow temperature. In addition, hot gas temperature may be controlled in response to system gas temperature by regulation of fresh primary air flow to the generator. Exhaust gases from the hot gas generator are introduced into the system return flow at the circulation starting point to repeat the process.

6 Claims, 1 Drawing Figure

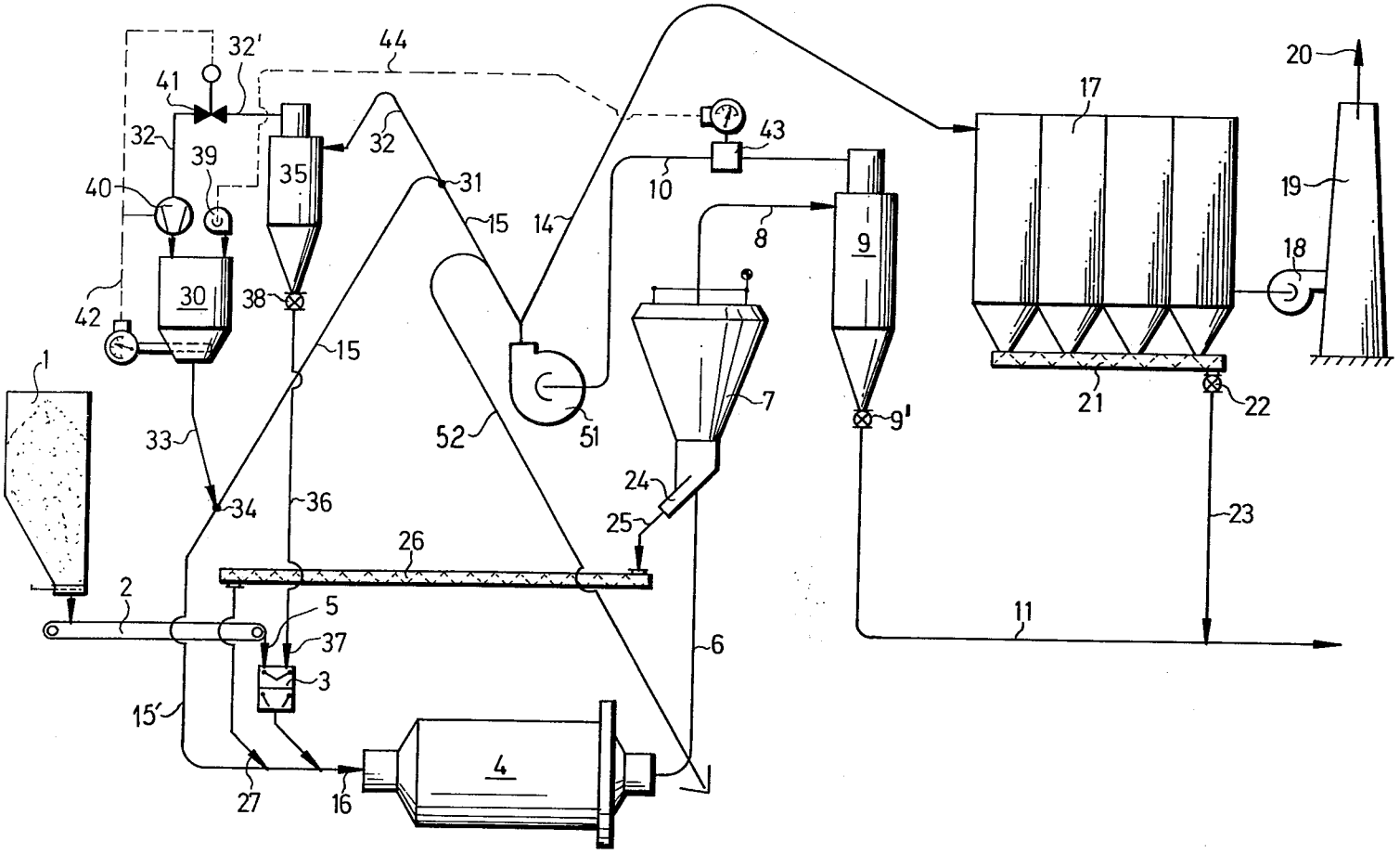
20
19
18
22
23
17
21
11
9'
9
43
8
7
6
10
24
25
51
14
15
31
52
4
44
32
26
15
16
36
5
37
3
35
38
32'
39
34
27
41
30
33
32
40
42
15'
2
1

METHOD AND DEVICE FOR THE OPERATION OF A HOT GAS GENERATOR WITHIN A DRYER

BACKGROUND OF THE INVENTION

1. Field of the Invention

The present invention relates to operation of the hot gas generator for a dryer system, particularly the dryer system for a pulverizing mill assembly.

2. The Prior Art

It is known to incorporate a dryer arrangement in a comminuting or pulverization system, such as a coal briquetting mill assembly. Generally, pulverization systems including a dryer arrangement may be called "grinding dryer assemblies".

A grinding dryer assembly requires hot gases for drying. These gases are produced by a hot gas generator. In some cases, the hot gases are diverted from the exhaust flow of a combustion unit functioning in the system. Hot gas generators require a supply of primary combustion air, which is oxygen-rich, for generating a flame and a flow of secondary air for cooling the combustion gases and setting the desired temperature for the hot gas to be delivered.

Typically in the prior art, secondary air is supplied from the ambient as, for example, shown in German Auslegeschrift No. 1,283,655. The result is a hot gas supply having a relatively high oxygen content, for example on the order of 14 through 18 percent oxygen, which may cause afterburning. A further drawback in providing ambient secondary air is that relatively cool environmental air has a quenching effect as the combustion process, resulting in higher combustion operation costs.

In contrast to drawing secondary air from ambient, the hot gas generator can be placed in the return gas line for a grinding dryer assembly as, for example, shown in German PS No. 475815. However, the hot gas generator must have an extremely large flow cross section to accommodate throughput of the entire return gas flow of the assembly, which represents an extravagent need for space and high manufacture costs. A further disadvantage with this approach occurs in that the operations and controls for the hot gas generator and grinder dryer system become interrelated, since there is a functional coupling of the two devices, which makes individual control of each device difficult. In addition, solid particles entrained in the assembly gas flow may be combusted in the hot gas generator, especially coal dust particles, which interferes with regulation of the generator. During start up of the circulation system using this approach, there is an increased risk of explosion in the hot gas generator since gas flow through the generator does not occur until a short time after the circulation blower is activated, due to inertia.

SUMMARY OF THE INVENTION

In accordance with the present invention, a dryer system includes a hot gas generator to supply drying gas into a gas circulation system. The hot gas generator is situated along a branch line into the circulation system so as to be functionally independent of the installation through which the dryer gas passes. Drying gas passes from a starting point in the circulation system to the downstream where system gas commingles with particles to be dried. The mixture of system gas and particles is then passed into a separator means from which product particles and system gas are separately removed.

Removed system gas is divided into a portion for return through the circulation system and a spent portion for expulsion to ambient. Part of the system return flow passes into a bypass line containing the hot gas generator.

In the bypass line, the partial gas stream passes through a compressor which delivers it into the hot gas generator as the secondary gas flow therein. Because the system gas is relatively oxygen-lean, the partial gas stream is effective in cooling the primary combustion mixture in the hot gas generator to the desired temperature. This effectiveness permits optimal stoichiometric conditions in the primary combustion mixture to be set. Because the partial gas stream is heated, there is no quenching effect and the combustion process may be run efficiently. Exhaust gases from the generator are re-introduced into the return gas flow at the circulation starting point for the process to repeat.

Hot gas temperature may be regulated by means of a variable valve element arranged in the branch line and controlled in response to operating conditions, such as temperature, in the generator. In addition, hot gas temperature may be controlled in response to system gas temperature by regulation of primary air flow through an intake blower.

In its preferred embodiment, the dryer system according to the present invention is incorporated in a grinding dryer installation wherein coal is pulverized and dried. The installation includes a milling element to receive a mixture of coal and system gas. From the milling element, the mixture passes into a sifter and then into a solids separator. Return gas flow is removed from the solids separator. The partial gas flow is conducted through a further solids separator in the bypass line to remove remaining particles which may disrupt the combustion process in the hot gas generator.

BRIEF DESCRIPTION OF THE DRAWING

The drawing is a schematic block diagram of a dryer system according to the present invention incorporated in a grinding dryer installation.

DESCRIPTION OF THE PREFERRED EMBODIMENT

The preferred embodiment relates to a grinding dryer installation in which coal is pulverized and dried, such as in a briquetting operation. However, those skilled in the art will readily appreciate that the present invention can be applied to any type of dryer and grinding dryer systems which utilize a hot gas generator.

Hot gas generators involving primary air and secondary air flows are well-known in the art. The present invention does not depend on the particulars of the hot gas generator except as described below; hence, this structure is left to engineering discretion.

The present invention may be incorporated in a standard grinding dryer installation as described below. The operational components of a standard grinder dryer installation are well-known in the art. The present invention does not depend on the particulars of these components except as described below; hence, these elements have been represented schematically.

Referring to the diagram, raw coal drops in doses from a supply hopper 1 onto a conveyor element 2. At the delivery end of the conveyor 2, the coal doses pass into a sluice means 3, shown as a double pendulum-type sluice, in the direction of arrow 5. From the sluice 3 the coal enters a dryer gas circulation system along line 15'. The coal commingles with the dryer gas in line 15', and the mixture is passed through the intake of a mill element 4 in the direction of arrow 16. Inside the mill element 4 the coal is crushed and pulverized by means of machinery known in the art while being dried by the dryer gas. Pulverized coal then travels along line 6 of the circulation system to a sifting element 7 which contains machinery known in the art for segregating oversize or rough coal particles.

The oversize material is removed from the sifter 7 at a location represented by 24 and passed through pathway 25 to recycling means, such as a screw conveyor 26. The conveyor 26 conducts sifted coal to be returned through the mill 4 by passing it into the circulation line 15' as indicated by arrow 27 just upstream of the introduction of the raw coal.

A mixture of system gas and selected coal particles is passed from the sifter 7 along line 8 to an installation separator means 9, such as a cyclone separator. The installation separator 9 serves to segregate the coal product from the gas. Coal product particles are withdrawn from the separator 9 via sluice means, such as a bucket wheel sluice 9', and passed through an installation discharge line 11 for, possibly, further finishing.

System gas is withdrawn from the installation separator 9 along line 10 leading to an intake for an installation circulation blower 51. Discharge from the blower 51 is divided between flow lines 14 and 15 into spent gas flow and return gas flow, respectively. Spent gas flow is drawn through a filter means 17, such as a perpendicular device, by a discharge blower means 18. The blower 18 delivers the filtered spent gas to a chimney means 19, which expels the gas to ambient as indicated by arrow 20.

Solid particles removed from the spent gas flow by the filter means 17 may be deposited, such as gravimetrically, onto a conveyor means, such as screw conveyor 21. The conveyor 21 serves to pass the particles via sluice means, such as bucket wheel sluice 22, into a line 23. Line 23 joins with the installation discharge line 11 such that the filtered particles are removed from the installation as product discharge.

Return gas flow passes along line 15 and 15' for recirculation to the intake of the mill element 4. A portion of the return gas flow may be withdrawn via a branch line 52 for uses outside the installation, such as for space heating. At a point 31 just downstream of the blower 51, the return gas flow is divided so that a part of the return gas flow passes into a branch line 32 for a bypass line arrangement which includes a hot gas generator 30.

In the line 32, the partial gas stream is passed through a separator means 35, such as a cyclone separator, to further reduce the particle content in the gas. For example, it is expected that system gas passing through line 15 will have a particle content of between 30 and 60 g. per $m^3$ and that the particle content of branch line gas leaving the separator 35 will be between 3 and 10 g. per $m^3$, preferably about 8 g. per $m^3$. The solids removed by the separator 35 may be passed via sluice means, such as bucket wheel sluice 38, through line 36 into the double pendulum-type sluice means 3 as indicated by arrow 37. Within sluice means 3, the branch line-removed particles commingle with raw coal from the hopper 1 for passage to the mill element 4.

The cleaned branch gas stream is drawn from the separator 35 into line portion 32' of the branch line 32 by a compressor means 40. The compressor 40 introduces this system gas as secondary air flow for the hot gas generator 30. In known manner, the secondary gas mixes with primary combustion gases in the generator 30 to cool flame temperatures. Primary combustion air is supplied to the generator 30 from ambient via a blower means 39. The partial gas stream is passed through separator 35 prior to being introduced into the gas generator to minimize the risk of disruption of the combustion process with the presence of burnable coal particles in the secondary gas.

Hot gases are discharged from the generator 30 into exit line 33 of the bypass arrangement. These hot gases are introduced into the main body of return gas flow in line 15 at juncture 34 to make the flow of installation dryer gas. In this manner, the gas circulation system is continuous, so that system gas is recirculated. From point 34' the dryer gas passes through line 15' for mixture with raw coal and recycled coal particles being fed to the mill element 4, so that the dryer system process repeats.

In accordance with the present invention, the bypass arrangement in which the hot gas generator 30 is located enables operation of the generator to be independent of the grinding dryer installation operation.

Further, fresh air containing a relatively high oxygen content for secondary gas flow into the hot gas generator 30 is eliminated. Use of relatively oxygen-lean system gas enables the secondary gas introduction in the generator 30 to more effectively cool the combustion process than if fresh ambient air were provided. Accordingly, the primary combustion mixture in the generator 30 may be set at stoichiometric conditions for optimum performance. Because the partial gas flow has been heated, there is no problem with quenching by the secondary gas in the generator 30. Primary combustion temperatures to be cooled may be on the order of 1600° through 1800° C. Temperatures of hot gases being emitted from the generator 30 may be maintained as desired by means of a secondary gas regulator mechanism. The secondary gas regulator may utilize an operating condition within the gas generator, such as a temperature signal 42, to control a variable valve or choke element 41 positioned in the partial gas stream flow line 32, preferably downstream of the segregator 35, or to vary the delivery of the secondary gas compressor 40. The regulator system may be electrically or solenoid actuated in a fashion well-known in the art.

Hot gas temperatures from the generator 30 may be controlled in response to system gas temperature in similar fashion. A temperature transducer device 43 may be positioned within the dryer gas circulation system, preferably downstream of the installation separator 9. The temperature signal 44 from the transducer 43 is used to vary the delivery of the primary combustion air blower 39, thereby affecting the fuel-air mixture burn in the generator 30.

Although various minor modifications may be suggested by those versed in the art, it should be understood that we wish to embody within the scope of the patent warranted hereon all such modifications as reasonably and properly come within the scope of our contribution to the art.

We claim as our invention:

1. A method of operating a grinding dryer installation for pulverizing and drying solid particles, said installation comprising a mill element, a solids separator, and a dryer system including a circulation blower, a gas circulation system for conducting system gas in combination with said solid particles to be dried and recycling a return gas flow, and a hot gas generator, said method comprising:

mixing raw solid particles with system gas, introducing system gas mixed with solid particles into said milling element, passing said mixture from said mill element into said solids separator, removing system gas from said solids separator as return gas flow, branching off a part of said return gas flow from a main return gas flow, passing said partial gas flow into said hot gas generator to serve as secondary air flow therein, introducing hot gases from said hot gas generator into said main return gas flow to form system gas, conducting said partial gas flow through a further solids separator means prior to being introduced into said hot gas generator, and conducting separated solids from said further solids separator means into mixture with system gas prior to its introduction into said mill element.

2. The method according to claim 1, further comprising:

passing said return gas flow through said circulation blower prior to branching off said partial gas flow.

3. The method of claim 1, further comprising:

branching off a portion of return gas flow for expulsion to ambient prior to branching off said partial gas flow.

4. A grinding dryer installation for pulverizing and drying solid particles comprising means forming a mixture of system gas and solid particles, a mill element for receiving said mixture, a solids separator for receiving said mixture from said mill element and discharging a return gas flow therefrom, and a dryer system comprising a hot gas generator, a circulation blower, and a gas circulation system for conducting said mixture and recycling said return gas flow, said dryer system further comprising a bypass line arrangement containing said hot gas generator, said bypass line dividing a part of said return gas flow from a main return gas flow through said circulation system, delivering said partial gas flow into said hot gas generator as secondary air flow therein, and conducting hot gases from said hot gas generator into mixture with said main return gas flow to form system gas for circulation through said dryer system, said bypass line dividing off said partial gas flow downstream of said solids separator and passing said partial gas flow through a further solids separator prior to introduction into said hot gas generator, said installation further including means for conducting separated solids from said further solids separator into mixture with said system gas prior to its introduction into said mill element.

5. The dryer system according to claim 4, further comprising a choke means in said bypass line for regulating the amount of partial gas flow into said hot gas generator in response to operating conditions in said generator.

6. The dryer system according to claim 4, wherein primary combustion air is delivered into said hot gas generator from ambient by a blower means.

* * * * *